United States Patent [19]

Abbott et al.

[11] Patent Number: 4,835,663

[45] Date of Patent: May 30, 1989

[54] LIQUID FUEL CONSUMING APPARATUS

[75] Inventors: David K. Abbott; Hansjuergen Riha, both of Dublin, Ireland

[73] Assignee: Noel Christopher Kavanagh, Dundrum, Ireland

[21] Appl. No.: 72,973

[22] PCT Filed: Nov. 18, 1986

[86] PCT No.: PCT/GB86/00703

§ 371 Date: Sep. 10, 1987

§ 102(e) Date: Sep. 10, 1987

[87] PCT Pub. No.: WO87/03064

PCT Pub. Date: May 21, 1987

[30] Foreign Application Priority Data

Nov. 18, 1985 [IE] Ireland ..... 2880/85

[51] Int. Cl.[4] ..... F21S 13/00

[52] U.S. Cl. ..... 362/159; 362/266; 362/209; 362/161; 431/320

[58] Field of Search ..... 362/159, 171, 228, 392, 362/806, 810, 295, 209, 266, 161; 431/320, 321, 323, 344

[56] References Cited

U.S. PATENT DOCUMENTS

| | | | |
|---|---|---|---|
| 1,626,008 | 5/1923 | Muller-Thym | 431/320 |
| 2,658,168 | 11/1953 | Matson | 362/810 |
| 3,204,433 | 9/1965 | Bureau | 431/33 |
| 4,110,066 | 8/1978 | Murphy | 431/320 |
| 4,261,695 | 4/1981 | Reninger | 431/320 |
| 4,511,952 | 4/1985 | Vanbragt | 431/344 |
| 4,608,011 | 8/1986 | Comstock | 431/320 |

FOREIGN PATENT DOCUMENTS

| | | | |
|---|---|---|---|
| 49715 | 4/1889 | Fed. Rep. of Germany . | |
| 186627 | 1/1906 | Fed. Rep. of Germany . | |
| 877445 | 12/1942 | France | 431/323 |

*Primary Examiner*—Ira S. Lazarus
*Assistant Examiner*—D. M. Cox
*Attorney, Agent, or Firm*—Armstrong, Nikaido, Marmelstein, Kubovcik & Murray

[57] ABSTRACT

Liquid fuel consuming apparatus for use as a devotional candle or votive light arrangement comprises a reservoir housing a horizontally oriented tubular shape with a series of holes in its top face aligned with an equal series of fuel holding wells provided on an insert located in the reservoir. A non-removable wick in a holding tube is provided in each aligned hole and well with its top above the hole and its bottom in the well. Means are provided to fill the wells with fuel from a tank. Through capillary action fuel passes up the wick. The amount of fuel in the well is determined by the capacity of the well, and therefore the illuminating time period for a wick after being ignited.

15 Claims, 1 Drawing Sheet

LIQUID FUEL CONSUMING APPARATUS

This device relates to a liquid consuming apparatus particularly, but not exclusively, suitable for use as an alternative for a single or multiple devotional candle or votive light arrangement in churches.

In accordance with one aspect of the present invention, a liquid fuel consuming apparatus comprises a reservoir, at least one wick being located in the reservoir to extend up through a top thereof and extend downwardly into a fuel holding device located in or forming part of the reservoir, the capacity of which device determines the illuminating time period of the respective wick after being ignited, and means to fill the device with fuel.

In accordance with a second aspect of the present invention, a liquid fuel consuming apparatus comprises a tubular reservoir, horizontally oriented or substantially so, a longitudinal series of holes being provided in the top thereof up through each of which a wick extends, the bottom of the wicks extending downwardly each in to a respective fuel holding device located in, or being provided in the bottom of, the reservoir, the capacity of each device determining the illuminating time period of the respective wick after being ignited, and means to fill the device with fuel.

Preferably, the holding devices are provided in an insert locatable in the reservoir prior to being liquid tightly closed.

Preferably, the insert is a bar having a series of wells provided extending down from its top face, the well dimensions being determined to give a particular capacity.

Alternatively, the insert is a tray having a series of upstanding tubular elements liquidtightly welded thereto and each providing internally thereof a well to receive fuel.

Preferably further, two or more reservoirs are provided in a tiered formation. The reservoirs may be elongate or may be rectangular, circular, oval or other enclosed geometrical figure in plan view.

Preferably further, the wicks are of a non-inflamable material, for example glass fibres. The glass fibres are preferably held in a tube, the fibres extending a short distance out of the holding tube at the top and bottom. Each tube is secured to prevent its removal from the reservoir.

The means to fill the device with fuel preferably comprises a pipe connected to a pump in communication with fuel in a tank, the fuel being pumped into the reservoir and into the wells, with the excess fuel being allowed to return to the tank through the pipe when the pump is de-energised. The pump is preferably located in the fuel tank and is energised from a source of electricity. A timing mechanism is provided to interrupt the flow of electricity to the pump and to allow only pulses of electricity to the pump during preset time intervals.

An overflow pipe is preferably provided to allow pumped but unrequired fuel to return to the tank.

An embodiment of the present invention will now be described, by way of example, with reference to the accompanying drawings, in which.

Figure 1:
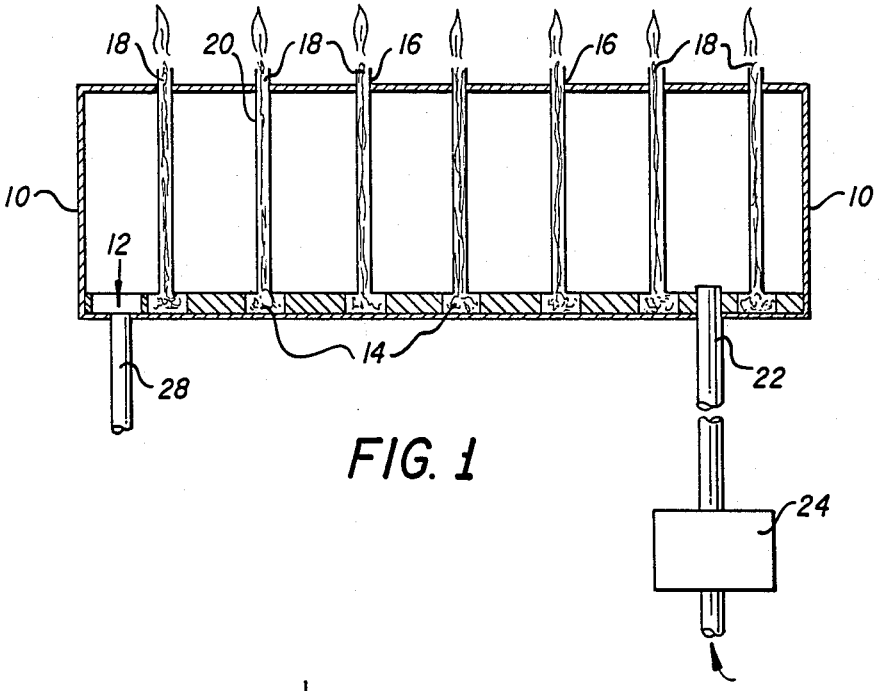
FIG. 1 is a diagrammatic longitudinal cross sectional view of the apparatus of the present invention.

Referring to the drawings, a liquid fuel consuming apparatus comprises a tubular reservoir 10 of a rectangular cross section. The reservoir is elongate and horizontally orientated or substantially so. An insert 12 is provided for location in the interior of the reservoir. The insert 12 has a series of wells defining fuel holding devices. The insert 12 is a bar having the wells 14 provided extending down from its top face. The dimensions of the wells 14 are determined to give a particular capacity for holding fuel. After the insert is located in the reservoir 10, the ends are liquidtightly closed. A longitudinal series of holes 16 is provided in the top of the reservoir 10, the number in the series being equal to the number of wells being aligned with the wells 14. A wick 18 is located in each hole to extend upwardly there through and downwardly into the respective well 14. The wicks 18 are of a permanent nature, and are formed of non-inflamable glass fibres. The fibres are fed through and are held in a tube 20 with fibres extending a short distance beyond the top and bottom of the tube 20. Each tube is secured to prevent its removable from the reservoir 10.

Means to fill the devices with fuel comprises a pipe 22 connected to a pump 24 in communication with fuel in a fuel tank 26. The pump 24 is located in the fuel tank 26 and is energised from a source of electricity 34 such as mains power or power from an outside generator, or other source.

A timing mechanism 36 of known mechanical or electronic construction is provided to interrupt the flow of electricity to the pump and to allow only pulses of electricity to the pump during preset time intervals.

An overflow pipe 28 is provided to allow pumped but unrequired fuel to return to the tank 26.

Figure 2:
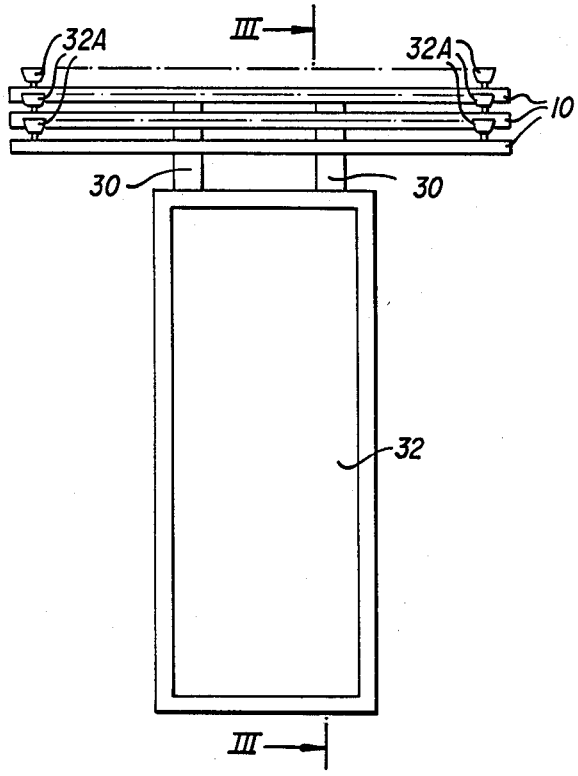
FIG. 2 is a front elevational view of this embodiment showing a three tiered formation of the apparatus to a different scale.
Figure 3:
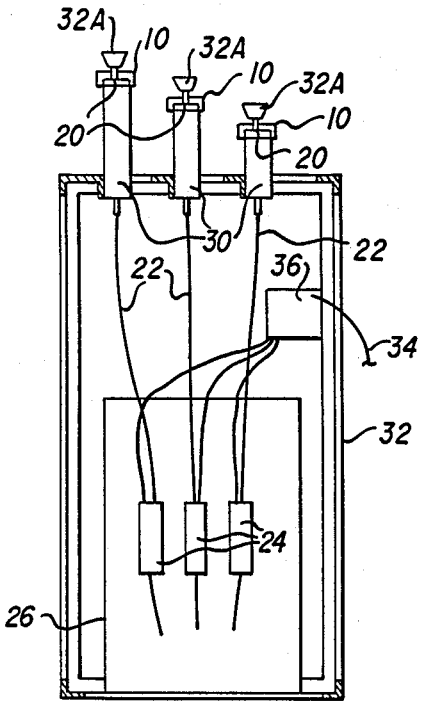
FIG. 3 is a vertical cross sectional view on the line III-III of FIG. 2.

FIGS. 2 and 3 show a particular embodiment with three reservoirs 10 arranged in a tiered formation. Each reservoir is supported by two columns 30 from the top of a cabinet 32 which houses the fuel tank 26. The columns of each reservoir are hollow and house part of the pipe 22 and overflow pipe 28, one in each column. The parts of the pipes 22 and 28 in the columns are preferably of metal, the top of the pipe 28 being level with the bottom of the reservoir 10 and the top of pipe 22 projecting up a short distance above the top of wells 14. The other parts of the pipes 22 and 28 are of flexible material and extend into the tank 26. Each reservoir 10 can be provided with a separate pump, however, if required, one pump can be provided for the three reservoirs, the pump being connected to the pipes 22 through a 'T' junction pipe (not shown).

The cabinet has a door openable for access to the tank, the door being lockable and provided at the rear of the cabinet.

Around each wick projecting out of its respective hole 16, an egg-cup shaped glass 32 is provided, the top of the glass being above the level of any flame when a wick is lit.

In use, fuel is fed when the pump(s) is/are energised and flows up pipes 22 into the reservoirs 10 and into the wells 14. Fuel is continued to be fed thereinto so long as the pump(s) is/are energised. The surplus fuel after the wells 14 are filled flows along the reservoirs and flows out of pipe 28 back into the tank. When the pump(s) stop, the fuel still in the pipes 22 flow back down into the tank. If the wells are dimensioned to hold sufficient fuel to allow the wicks to burn for say 20 minutes, then the timing mechanism is set to energise the pumps(s) every 20 minutes. In some instances, a wick may only be lit just before the pump is energised. If this is the case, then that particular wick will continue to burn for a further 20 minutes since its respective well will have been filled up with fresh fuel. The fuel flows up the wicks by capilliary action.

In a modification of the insert, it can be formed by a tray on which the required number of wells are provided by a series of upstanding tubular elements liquid-tightly welded to the tray, the wells being provided internally of said welded elements.

The reservoirs can be of any particular shape, semi-circular, horse shoe or rectangular, circular, oval or other enclosed geometrical figure in plan view.

In a further modification, the reservoir may be of upright tubular shape having an insert with only one well whose dimensions are greater than those hereinbefore to give it a fuel capacity for several hours of illuminating time.

The means to fill the device(s) may be by hand or by gravity through an opening in the top of the reservoir, an overflow pipe 228 being provided to allow excess fuel to drain from the reservoir to a collecting tank.

A suction pump can be connected to the overflow pipe 28, if required.

The insert with wells may be preformed from a mouldable or cast material.

What is claimed:

1. A lighting apparatus, comprising: a closed reservoir; at least one wick located in the reservoir which extends up through a top portion of the reservoir and extends downwardly into the reservoir; and means for supplying fuel to the reservoir, wherein the reservoir has a substantially equal number of fuel holding devices corresponding to the number of wicks provided with each wick extending downwardly into a corresponding holding device, wherein each holding device has a capacity which, when full, determines the illuminating time period of each respective wick, and wherein the means for supplying fuel to the reservoir comprises a fuel supply tank located below the reservoir from which fuel is pumped to the reservoir at periodic time intervals to replenish each holding device with any surplus fuel overflowing from each holding device and draining from the reservoir to the tank.

2. A lighting apparatus, comprising: a closed tubular reservoir having a series of apertures passing through the top portion thereof; a series of wicks, each wick extending up through each hole, and the bottom of each wick extending downwardly into the reservoir; and means for supplying fuel to the reservoir, wherein the reservoir is oriented in a substantially horizontal manner and with the series of apertures being longitudinal with respect to the reservoir, and wherein the reservoir has a substantially equal number of fuel holding devices corresponding to the number of wicks provided with each wick extending downwardly into a corresponding holding device, and wherein each holding device has a capacity which, when full, determines the illuminating time period of the corresponding wick, and wherein the means for supplying fuel to the reservoir comprises a fuel supply tank located below the reservoir from which fuel is pumped to the reservoir at periodic time intervals to replenish the holding devices with any surplus fuel overflowing from the holding devices and draining from the reservoir to the tank.

3. The lighting apparatus according to claim 2, wherein the fuel holding devices comprise wells in an insert in the reservoir placed therein prior to having the reservoir sealed, wherein each well has a specific capacity.

4. The lighting apparatus according to claim 3, wherein the insert is a bar having a series of wells extending down from the top face portion thereof.

5. The lighting apparatus according to claim 3, wherein the insert is a tray having a series of upstanding tubular elements which are tightly welded for liquids, and wherein each tubular element has an internal well for receiving fuel.

6. The lighting apparatus according to claim 2, wherein at least two of the reservoirs are provided in a tiered formation.

7. The lighting apparatus according to claim 1 or 2, wherein the wicks are of a non-inflammable material.

8. The lighting apparatus according to claim 7, wherein each wick is held in a tube, and wherein each wick extends a short distance out from the top and bottom portions of the holding tube.

9. The lighting apparatus according to claim 8, wherein each tube is secured to prevent its removal from the reservoir.

10. The lighting apparatus according to claim 1 or 2, wherein the means for supplying fuel to the reservoir comprises a pipe connected to a pump in communication with fuel in the tank, wherein the fuel is allowed to return to the tank through the pipe when the pump is de-energized.

11. The lighting apparatus according to claim 10, wherein the pump is located in the fuel tank and is energized from a source of electricity.

12. The lighting apparatus according to claim 10, further comprising a timing mechanism for interrupting the flow of electricity to the pump and for allowing only pulses of electricity to the pump during preset time intervals.

13. The lighting apparatus according to claim 10, further comprising an overflow pipe for allowing pumped but unrequired fuel to return to the tank.

14. The lighting apparatus according to claim 1 or 2, further comprising a substantially egg-cup shaped glass around a projecting top of each wick.

15. The lighting apparatus according to claim 6, further comprising a cabinet where at least three reservoirs are arranged in a tiered formation, wherein each reservoir is supported by columns above the cabinet which houses the fuel tank.

* * * * *